US008354973B2

(12) United States Patent
Kinghorn et al.

(10) Patent No.: US 8,354,973 B2
(45) Date of Patent: Jan. 15, 2013

(54) ANTENNA

(75) Inventors: Anthony Kinghorn, Midlothian (GB); Ronald Lyon, Midlothian (GB); Angus David McLachlan, Midlothian (GB); Graeme Dick Morrison, Midlothian (GB)

(73) Assignee: Selex Galileo Ltd, Basildon, Essex (GB)

( * ) Notice: Subject to any disclaimer, the term of this patent is extended or adjusted under 35 U.S.C. 154(b) by 329 days.

(21) Appl. No.: 12/673,466

(22) PCT Filed: Aug. 14, 2008

(86) PCT No.: PCT/EP2008/060718

§ 371 (c)(1),
(2), (4) Date: Feb. 12, 2010

(87) PCT Pub. No.: WO2009/024539

PCT Pub. Date: Feb. 26, 2009

(65) Prior Publication Data

US 2010/0201601 A1 Aug. 12, 2010

(30) Foreign Application Priority Data

Aug. 17, 2007 (GB) ..... 0716116.9

(51) Int. Cl.
*H01Q 21/00* (2006.01)

(52) U.S. Cl. ..... 343/853; 343/893; 343/753; 343/754; 342/368; 342/372; 342/374

(58) Field of Classification Search ..... 343/753, 343/754, 853, 893; 342/368, 372, 374
See application file for complete search history.

(56) References Cited

U.S. PATENT DOCUMENTS

| | | | | |
|---|---|---|---|---|
| 4,791,421 | A * | 12/1988 | Morse et al. | 342/368 |
| 5,493,305 | A | 2/1996 | Wooldridge et al. | |
| 5,854,607 | A * | 12/1998 | Kinghorn | 343/853 |
| 5,995,062 | A * | 11/1999 | Denney et al. | 343/853 |
| 6,278,400 | B1 | 8/2001 | Cassen et al. | |
| 6,441,783 | B1 * | 8/2002 | Dean | 342/372 |
| 6,784,837 | B2 * | 8/2004 | Revankar et al. | 342/372 |
| 6,937,471 | B1 * | 8/2005 | Haws et al. | 361/699 |
| 7,129,908 | B2 * | 10/2006 | Edward et al. | 343/878 |
| 7,265,719 | B1 | 9/2007 | Moosbrugger et al. | |
| 7,391,382 | B1 * | 6/2008 | Mason et al. | 343/754 |
| 2002/0185718 | A1 | 12/2002 | Mikubo et al. | |
| 2003/0011515 | A1 | 1/2003 | Warble et al. | |
| 2005/0151215 | A1 | 7/2005 | Hauhe et al. | |

FOREIGN PATENT DOCUMENTS

| | | |
|---|---|---|
| EP | 0 620 613 A2 | 10/1994 |
| GB | 2 397 697 | 7/2004 |
| WO | WO 02/19469 | 3/2002 |

OTHER PUBLICATIONS

International Search Report of Application No. PCT/EP2008/060718 dated Nov. 28, 2008.

(Continued)

*Primary Examiner* — Hoang V Nguyen
(74) *Attorney, Agent, or Firm* — Buchanan Ingersoll & Rooney PC

(57) ABSTRACT

A phased array antenna is disclosed where the transmit/receive modules are replaced by a series of separately packaged components. The components include, for example, a vector control component, a high power amplifier component, a low noise amplifier component, a transmit/receive duplexing component and ancillary supporting components. An advantage of this arrangement is that cheaper antenna arrays can be constructed without limiting the capability and/or performance of a system incorporating such an array when compared to known solutions.

20 Claims, 2 Drawing Sheets

OTHER PUBLICATIONS

Notification of Transmittal of the International Search Report and the Written Opinion of the International Searching Authority (Forms PCT/ISA/220, PCT/ISA/210 and PCT/ISA/237) Issued in the corresponding International Application No. PCT/EP2008/060718 dated Nov. 11, 2008.

Search Report issued in the corresponding United Kingdom Application No. GB0716116.9 dated Apr. 2, 2008.

* cited by examiner

ANTENNA

FIELD

This invention is concerned with new phased array antennas eliminating the need for numerous discrete transmit/receive modules, thereby reducing the cost of such array antennas. More specifically but not exclusively, the invention relates to a phased array antenna comprising discrete components in place of transmit/receive modules.

BACKGROUND

The general trend in the art, when constructing phased array antennas, is to determine the highest operating frequency of an antenna to be constructed and, based on the requirements for spacing the radiating elements that result from this selected operating frequency, placing radiating elements coupled to transmit/receive modules at exactly this spacing to minimise the number of transmit/receive modules used. Each transmit/receive module is a distinct entity which performs the functions of high power transmission, reception and gain/phase control for beam forming and beam steering. However, this is not a very cost-effective method of constructing a phased array antenna, as such transmit/receive modules are usually very expensive and are not readily assembled into a complete antenna.

SUMMARY

Accordingly, the present invention provides a phased array antenna comprising: a plurality of communication units; the communication units comprising a series of components collectively performing the function of a plurality of conventional transmit/receive modules.

The present invention aims to replicate the functionality of a known form of phased array antenna, i.e. the radiating element spacing is the same and the power output per element is the same. In known antennas, each radiating element is connected to an identical transmit/receive module—in the antenna of the invention, each radiating element is connected to a number of separately packaged components which together replicate the functionality of the conventional transmit/receive modules. In the present invention, the main components which implement the required transmit/receive functionality are preferably implemented in two packages, a 'low power' and 'high power' unit.

Preferably, each communication unit consists of a single printed circuit board further including all supporting circuitry required by the phased array antenna.

BRIEF DESCRIPTION OF THE DRAWINGS

The invention will now be described with reference to the accompanying drawings in which.

DETAILED DESCRIPTION

Figure 1:
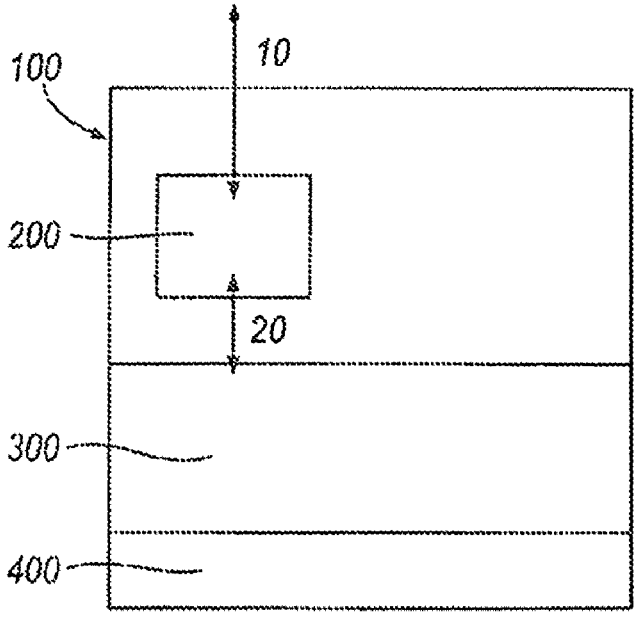
FIG. 1 is a schematic diagram of a known form of phased array antenna comprising a series of communication modules connected to a series of radiating elements, each communication module being in the form of a transmit/receive module.

The phased array antenna shown in FIG. 1, which shows the configuration of the array antenna 100 behind the array face 400 on which the radiating elements 410 are located. Each radiating element 410, 410', 410" is in communication with a transmit/receive module 500, 500', 500" (as shown by arrows 34, 34', 34") which is in turn in communication with combining element 450 (as shown by arrows 32, 32', 32"). Each combining element 450 is in turn in communication (as shown by arrow 36) with the main array portion 300. A plurality of transmit/receive modules 500 may be in communication with one combining element 450. Alternatively more than one combining element is then combined.

Figure 2:
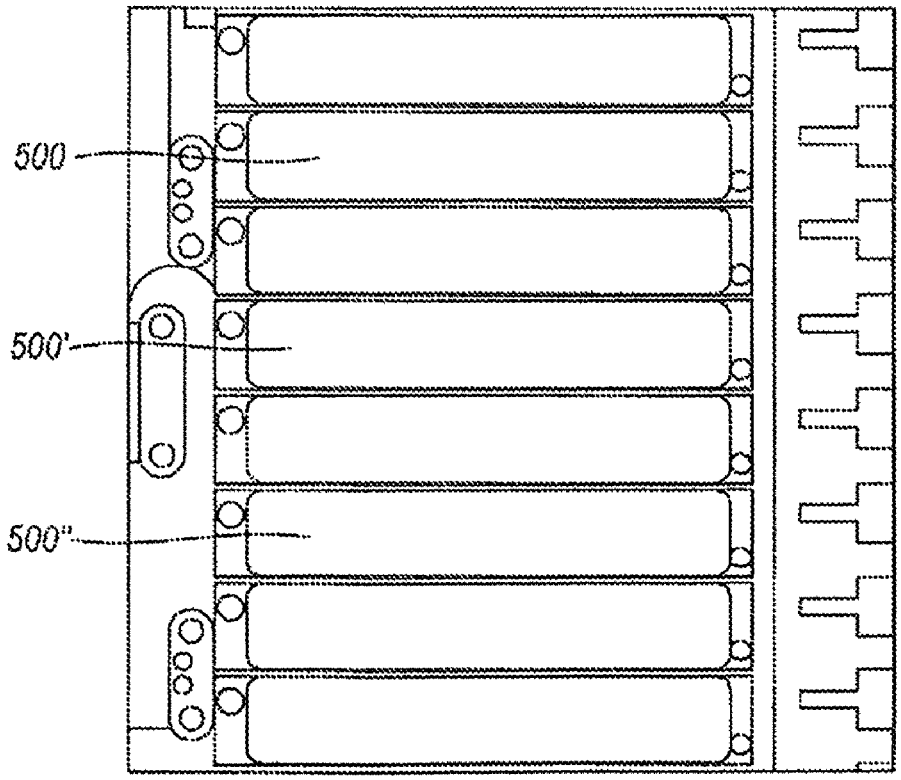
FIG. 2 is a schematic diagram showing the transmit/receive modules of the known form of phased array of FIG. 1.

FIG. 2 shows the configuration of the transmit/receive modules 500, 500', 500" in the phased array antenna of FIG. 1.

Figure 3:
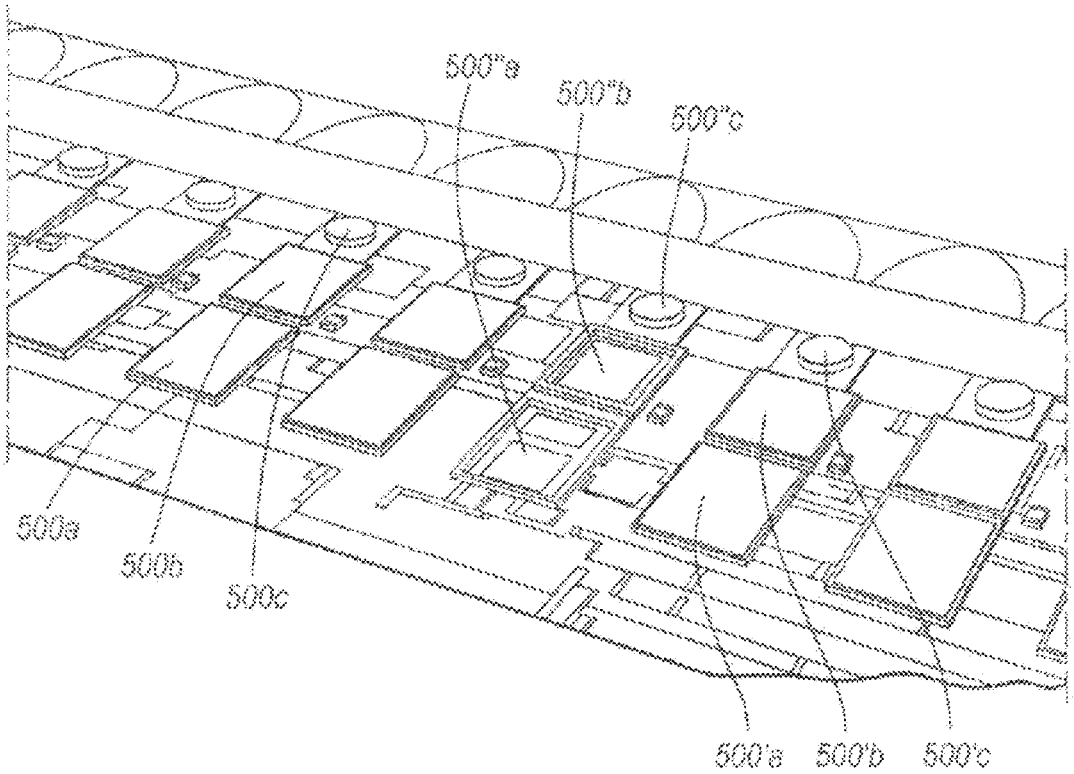
FIG. 3 is a schematic diagram of a phased array antenna in accordance with the invention, showing a communication unit, the communication unit comprising a plurality of components having the functionality of plurality of transmit/receive modules.

In the phased array antenna of FIG. 3, in accordance with one aspect of the invention, the transmit/receive modules 500, 500' and 500" have been replaced by a series of components 500*a, b* and *c*, 500'*a, b* and *c* and 500"*a, b* and *c*. The components together perform the function of transmit/receive modules and advantageously may be mounted on a single circuit board also comprising any supporting circuitry required and normally external to the transmit/receive modules.

Components 500*a, b* and *c*, 500'*a, b* and *c* and 500"*a, b* and *c* may comprise a low power module, incorporating two chips in a package. (the purpose of this low power module being gain/phase shifting on transmit and receive, overall control, and generation of a low level drive signal for transmit); a high power module, which again is a multi-chip package (the purpose of the high power module being to amplify the low level transmit signal); a low noise amplifier/protection switch module (which may be one of two variants, one with this as a separate unit, the other with it inside the high power module); a surface-mount circulator (which may be replaced with a transmit/receive switch) and a small number of simple components such as capacitors. In addition the digital control circuitry will comprise a number of generally standard surface mount components. It will be appreciated that although specific examples are given above, these are not limiting and any combination of components may be used that achieve the desired effect.

The components 500*a, b* and *c*, 500'*a, b* and *c* and 500"*a, b* and *c* are mounted on the circuit board using surface mount packaging technology that advantageously can provide the required interconnects for power, control and high frequency microwave. As surface mount packages are utilised, industry standard soldering technologies may be used, whilst the required connectivity is attained. Special connections as described in GB Application No 0615389.4 (XA2192) entitled 'Antennas' may be used and are incorporated here by reference. These connections are essentially a pattern of Ball Grid Array solder balls which mimic a vertical co-axial transition. This connects a buried stripline in a printed circuit board up to the top surface, which then passes through the package where it is connected to the RF device or an internal piece of microstrip. Alternatively an RF transition for use with QFN (Quad Flat No leads) style packages may be used.

Traditional transmit/receive modules are metal/ceramic combinations so the temperature coefficients are well matched with the GaAs components inside the transmit/receive module, but this leads to a thermal mismatch with the antenna structure and hence compliant interconnects are a necessity. Advantageously, the use of a number of compact packages, in the place of traditional transmit/receive modules, reduces this thermal mismatch As the thermal mismatch is low, no compliant interconnect is required and simple soldering techniques can be utilised instead.

The soldering techniques referred to above may utilise Ball Grid Array (BGA) technology. This advantageously provides an excellent cooling mechanism. Traditionally, hot components would be mounted on a heat spreader attached to a cold wall to reduce the temperature of the components. In the case of compact packages, as BGA technology can be used, a plurality of solder balls under the discrete 'hot' components conduct heat through thermal vias that can be designed into the circuit board. The board can then be bonded to a cold wall, thereby simplifying the design and structure of the communication unit. This also eliminates the need for separate mechanical fixing of transmit/receive modules, as the components are of sufficiently low mass that soldering provides a satisfactory method of attachment.

Traditional transmit/receive modules are 'packaged' in various ways (see FIG. 2) and are, as mentioned above, seen as a discrete entity for manufacture and test. This results in significant costs bound up in the approach, and that the splitting of the transmit/receive functionality into several individually packaged components is more cost-effective, smaller, simpler and much cheaper than traditional packages as shown in FIG. 2.

By way of example, transmit/receive module functionality can be achieved by the use of three main components: one for low power/control, one for high power, plus an external unpackaged circulator. A plurality of transmit/receive module equivalents are implemented on a single printed circuit board which can incorporate all power, control and RF interconnections, radiating elements, additional control and power supply circuitry to form a single communication unit. A plurality of such communication units is then simply assembled to form a complete phased array antenna. The phased array antenna described above mounts each communication unit on a cold wall, which may be cooled by various means depending upon the operating frequency of the antenna (which determines the dimensions) and the power density. By way of example, the antenna described employs a liquid cooling channel embedded in the cold wall to support the power densities required for an X-band antenna. The device has been proved successful for upward of 30 radiating elements on a single circuit board, although any number of radiating elements is envisaged.

The phased array antenna of the invention may be used over any frequency range but the advantages are particularly relevant to arrays operating at frequencies of 5 GHz and above.

The invention claimed is:

1. A phased array antenna comprising:

a plurality of transmit/receive module equivalents, each of the equivalents incorporating a low power/control portion, a high power portion and a circulator, wherein a plurality of the equivalents are implemented on a single printed circuit board, the circuit board incorporating at least power control, RF interconnections, radiating elements and control and power supply circuitry to form a single communication unit, and wherein a predetermined plurality of the communication units are assembled to form the phased array antenna of required characteristics, the number of the communication units assembled being determined by the required characteristics of the phased array antenna.

2. A phased array antenna according to claim 1, wherein each of the transmit/receive module equivalents comprises discrete components configured for combination in predetermined numbers to form a communication unit, of the required characteristics, on a single printed circuit board.

3. A phased array antenna according to claim 2, wherein the discrete components are configured to be connected to the antenna array using simple soldering techniques to avoid the requirement for compliant interconnects with a structure of the antenna.

4. A phased array antenna according to claim 3, wherein the soldering techniques comprise a Ball Grid Array (BGA) technology in which a plurality of solder balls are disposed under the discrete components to conduct heat through thermal vias arranged in the circuit board.

5. A phased array antenna according to claim 3, comprising:

cooling means for cooling hot components.

6. A phased array antenna according to claim 5, wherein the cooling means comprise a cold wall to which the circuit board is bonded, to reduce an operating temperature of the circuit board and simplify the design and structure of the communication unit.

7. A phased array antenna according to claim 6, wherein the cold wall is mounted on the circuit board on the side of the circuit board opposing the components.

8. A phased array antenna according to claim 7, wherein the components are mounted on the circuit board using a surface mount packaging technology to provide required interconnects for power, control and high frequency microwave.

9. A phased array antenna according to claim 3, comprising:

cooling means for cooling hot components.

10. A phased array antenna according to claim 9, wherein the cooling means comprise a cold wall to which the circuit board is bonded, to reduce an operating temperature of the circuit board and simplify the design and structure of the communication unit.

11. A phased array antenna according to claim 10, wherein the cold wall is mounted on the circuit board on the side of the circuit board opposing the components.

12. A phased array antenna according to claim 2, wherein the components are mounted on the circuit board using a surface mount packaging technology to provide required interconnects for power, control and high frequency microwave.

13. A phased array antenna according to claim 2, comprising:

cooling means for cooling hot components.

14. A phased array antenna according to claim 13, wherein the cooling means comprise a cold wall to which the circuit board is bonded, to reduce an operating temperature of the circuit board and simplify the design and structure of the communication unit.

15. A phased array antenna according to claim 14, wherein the cold wall is mounted on the circuit board on the side of the circuit board opposing the components.

16. A phased array antenna according to claim 15, wherein the components are mounted on the circuit board using a surface mount packaging technology to provide required interconnects for power, control and high frequency microwave.

17. A phased array antenna according to claim 1, comprising:

cooling means for cooling hot components.

18. A phased array antenna according to claim 17, wherein the cooling means comprise a cold wall to which the circuit board is bonded, to reduce an operating temperature of the circuit board and simplify the design and structure of the communication unit.

19. A phased array antenna according to claim 18, wherein the cold wall is mounted on the circuit board on the side of the circuit board opposing the components.

20. A phased array antenna according to claim 19, wherein the components are mounted on the circuit board using a surface mount packaging technology to provide required interconnects for power, control and high frequency microwave.

* * * * *